US005941167A

United States Patent [19]

Fleming

[11] Patent Number: 5,941,167

[45] Date of Patent: Aug. 24, 1999

[54] CAN CRUSHER

[76] Inventor: James B. Fleming, 63 Highland Park Dr., Chesterfield, Mo. 63017

[21] Appl. No.: 08/902,245

[22] Filed: Jul. 29, 1997

[51] Int. Cl.[6] ..... B30B 9/32

[52] U.S. Cl. ..... 100/45; 100/53; 100/216; 100/281; 100/902

[58] Field of Search ..... 100/45, 49, 53, 100/215, 216, 281, 283, 902

[56] References Cited

U.S. PATENT DOCUMENTS

| | | | |
|---|---|---|---|
| 2,737,995 | 3/1956 | Jennings . | |
| 2,982,200 | 5/1961 | Robertson et al. . | |
| 3,048,096 | 8/1962 | Guedel . | |
| 3,062,130 | 11/1962 | Huber et al. | 100/902 |
| 3,352,230 | 11/1967 | Hunnicutt | 100/902 |
| 3,659,520 | 5/1972 | Garrett et al. . | |
| 3,817,169 | 6/1974 | Bischoff . | |
| 3,857,334 | 12/1974 | Arp . | |
| 3,907,087 | 9/1975 | Tanaka | 100/902 |
| 3,916,780 | 11/1975 | Heiser . | |
| 3,960,070 | 6/1976 | McClure et al. . | |
| 4,216,713 | 8/1980 | Jung . | |
| 4,235,164 | 11/1980 | Allen et al. . | |
| 4,240,341 | 12/1980 | Whipple et al. . | |
| 4,265,170 | 5/1981 | Schulze, Jr. . | |
| 4,296,683 | 10/1981 | Lidik et al. . | |
| 4,459,906 | 7/1984 | Cound et al. . | |
| 4,474,108 | 10/1984 | Lonze | 100/902 |
| 4,550,658 | 11/1985 | Trolle . | |
| 4,606,265 | 8/1986 | Meier . | |
| 4,667,593 | 5/1987 | Kennedy . | |
| 4,771,685 | 9/1988 | Wagner . | |
| 5,048,413 | 9/1991 | Deiters . | |
| 5,327,822 | 7/1994 | Koenig . | |
| 5,381,732 | 1/1995 | Trout | 100/902 |
| 5,417,154 | 5/1995 | Plaats . | |
| 5,456,166 | 10/1995 | Belongia et al. . | |

FOREIGN PATENT DOCUMENTS

| | | | |
|---|---|---|---|
| 0222734 | 5/1987 | European Pat. Off. | 100/902 |
| 6-246491 | 9/1994 | Japan | 100/902 |
| 6-246494 | 9/1994 | Japan | 100/902 |
| 2272179 | 5/1994 | United Kingdom | 100/902 |
| 84/01126 | 3/1984 | WIPO | 100/902 |

*Primary Examiner*—Stephen F. Gerrity
*Attorney, Agent, or Firm*—Polster, Lieder, Woodruff & Lucchesi

[57] ABSTRACT

A portable can compactor of the present invention includes a housing, a chamber in the housing sized to accept aluminum beverage cans for compacting. A ram is reciprocally driven in the chamber to compact cans against a front wall or anvil of the chamber. The ram front surface is sloped relative to the anvil to reduce the amount of force needed to compact a can. A feed control includes a vane which pivots between an opened and a closed position in response to movement of the ram to prevent a second can from entering the chamber before a first can exits the chamber. The compactor is operated by a momentary-on push button switch. The switch is surrounded by a guard wall which extends around a least a portion of the push-button switch. A cut-off switch is closed by a removable feed tray when the feed tray is mounted to the compactor housing. The compactor therefore cannot be operated without the feed tray mounted to the housing. A support platform is provided to mount the can compactor over a collection or recycling bin, so that compacted cans (and residual fluids) will fall into the bin after they are compacted and exit the compactor. The support platform reinforces plastic recycling bins to substantially prevent an upper edge of the bin from bending over in response to the weight of the compactor.

16 Claims, 6 Drawing Sheets

CAN CRUSHER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to can compactors, and in particular, to an electric, automatic can compacting machine.

Can compactors have become popular as more and more people have begun to recycle aluminum cans, such as beverage (i.e. soda) cans. Can compactors can significantly reduce the volume occupied by the can, and thus makes it easier to collect cans for recycling. The available can compactors can be divided into two categories: manually operated can compactors and automatic can compactors. The manually operated can compactors typically involve a lever which is pulled to compact a can between two opposing surfaces. Such can compactors are often wall mountable. While manual can compactors work acceptably in the home where the number of cans to be compacted is not great, they become impractical where there are a large number of cans to be compacted or in school settings, workplaces, offices, factories, etc. where a large number of empty beverage cans accumulate and need to be compacted.

To facilitate compacting a larger number of cans, many have devised electric can compactors. Such can compactors typically rely on a piston or an eccentrically rotating member to compact cans either axially or longitudinally. These currently available compactors, however, are complex in construction, slow in operation, limited to 100% undeformed cans and fail to address the residual fluids problem (i.e. they provide no means to collect fluids left in the cans). Many are easily jammed, especially when accepting the first or last can in a series of can. Other deficiencies of existing can compactors include the fact that many operate continuously, and may present a danger with unattended operation. Further, they often cannot accept partially deformed cans or cans of different sizes. In addition, most compacted cans are still rather large.

Further, many of the can compactors presently available are designed to sit atop a table. However, most of the cans that are compacted have at least some liquid remaining. Some of the cans may be nearly full of liquid. When the cans are compacted in table top compactors, the remaining liquid spills out of the can compactor onto the table or floor, thereby creating a considerable mess that must be cleaned up.

The numerous significant deficiencies of presently available can compactors have discouraged acceptance and widespread use. Yet there is a major market awaiting a can compactor that will correctly and satisfactorily solve these significant deficiencies.

BRIEF SUMMARY OF THE INVENTION

A primary object of the present invention is to provide an automatic can compactor which is simple in construction, reliable, and easy to use.

Another object of the present invention is to provide such a can compactor which will substantially avoid jamming.

Another object is to provide such a can compactor which accepts cans of limited varying sizes and, although designed to compact cans longitudinally, it will also compact them laterally (axially).

Another object is to provide such a can compactor which is portable so that it can be easily carried from one location to another.

Another object is to provide such a can compactor which will accept partially deformed cans and cans with residual fluids.

Another object is to provide such a can compactor which can be started regardless of the position of the compacting ram of the compactor.

Another object is to provide a platform to support the can compactor above a standard, readily available receptacle to facilitate collection of compacted cans and any liquids left in the cans. The platform will also reinforce and stabilize weak top edges of these receptacles.

Briefly stated, a can compactor of the present invention is intended for use in garages, basements, schools, offices, shops, factories, etc. where large numbers of cans accumulate for recycling prior to transport of the cans to a major collection center. The can compactor includes a housing, a chamber in the housing sized to accept cans for compacting, a reciprocating ram which compacts cans in the chamber, a drive for reciprocally moving the ram between the forward and rearward positions, a hopper positioned above the chamber inlet, and a feed control which prevents a second can from entering the chamber before a first can exits the chamber. The chamber has a front wall, a back wall, a floor, a feed opening through which cans can enter the chamber to be compacted and an exit opening through which compacted cans can exit the chamber. The hopper, which is preferably a feed tray, is sized to accept cans and deliver these cans to the chamber for compacting.

The front wall of the chamber defines an anvil against which cans are compacted. The ram has a longitudinal axis and a front surface which engages the cans when compacting a can. To reduce the force required (and associated noise) to compact a can, either the ram front surface or the anvil lies in a vertical plane that is perpendicular to the longitudinal axis of the ram and the other surface is offset from the vertical plane to define a sloping surface. The sloping surface forms an angle of from about 1° to about 25° (and preferably of about 3° to about 10°) with the longitudinal axis of the ram. Preferably, it is the ram front surface which is sloped and comprises the sloping surface. The ram front surface slopes downwardly such that an upper surface of the ram is shorter than the lower surface of the ram. However, the ram front surface may be sloped in any plane to be effective. To keep the can generally axially centered with respect to the ram, the ram has a centering plug on its front surface and there are alignment rails on the bottom of the compacting chamber thereby creating a "T-shaped" ram face.

The feed control includes a vane pivotally mounted above the compacting chamber. The vane extends along a side of the chamber beneath the chamber opening and is pivotable between an upper position in which the vane closes the opening sufficiently to prevent a can from entering the chamber and a lower position in which the vane opens the chamber entrance to permit a can to enter the chamber to be compacted. A vane actuator is pivotally mounted in the housing to be movable between a first position and a second position in response to the reciprocal motion of the ram. A connecting rod extends between the vane and a vane actuator to operably connect the vane to the vane actuator. Thus, movement of the vane actuator from the first position to the second position moves the vane from its upper position and its lower position, and movement of the vane actuator from its second position to its first position moves the vane from its lower position to its upper position. The vane actuator is positioned in the housing to be in the path of movement of the ram such that the vane actuator is pivoted by the ram. When the ram moves rearwardly, the vane actuator is moved from its first position to its second position to move the vane from its upper position to its lower position to allow a can to enter the chamber. When the ram moves forwardly, the vane actuator moves from its second position to its first position to move the vane from its lower position to its upper position to prevent a can from entering the chamber. The vane actuator includes a side wall generally parallel to a side wall of the ram and the path of movement of the ram, and a slot in the vane actuator side wall. The connecting rod includes an arm having a first end fixed to the vane and a second end, and a finger extending from the arm and through the slot of the vane actuator. The slot is configured and positioned on the vane actuator side wall, such that the vane actuator and the connecting rod finger cooperate to translate pivotal motion of the vane rod to rotational motion of the arm; the rotational motion of the arm causing the vane to pivot between its upper and lower positions.

The compactor also includes a closure vane which at least partially closes the exit from the chamber. The closure is pivotally mounted to the compactor and biased to a closed position. The closure is opened by the weight of a compacted can exiting the chamber.

An actuating switch for actuating the drive is preferably a push-button momentary-on type of switch, which must be held down to operate the compactor. A guard surrounds the actuating push button. The guard is shaped and sized to prevent accidental actuation of the can compactor. The guard has a wall which extends around most of the push-button switch and has a height at least equal to the height of the push-button when the push-button is in a raised and off position. Preferably, the wall extends about 270° around the push-button to define an opening which facilitates the push-button switch being depressed.

A cut-off switch is also provided. The cut-off switch, actuating switch, and the drive make up an electrical circuit. The cut-off switch is movable between an open mode in which the circuit is opened and the drive cannot be actuated and a closed mode in which the drive can be actuated. The feed tray is removably mounted on either the side of the housing, and includes a finger which extends into the housing to close the cut-off switch and place the cut-off switch in the closed position. Thus, the compactor can only be operated when the feed tray is mounted on the compactor housing.

A support platform is provided to mount the can compactor over a collection or recycling receptacle, so that a compacted can will fall into the receptacle after it is compacted and exits the compactor. Preferably, the recycling receptacle is lined with a plastic bag or other disposable liner to facilitate collection of the compacted cans and any fluids which may be in the cans. The support platform includes a pair of elongate spaced apart support members having a first and a second end and a support surface extending between the support members from the first end of the support member. The support members are longer than the diameter of the receptacle. The support surface is shorter than the diameter of the opening such that when the support platform is placed on the receptacle, the support surface and the support members define an opening into the receptacle. The can compactor is positionable on the support platform such that the can compactor chamber exit is above the opening into the receptacle. The can compactor is configured to have a base which sits on the support platform. The exit from the chamber is positioned forwardly of the base, so that the compactor exit will be over the opening into the receptacle when the compactor is placed on the support platform. Thus, compacted cans will simply fall from the compactor into the receptacle.

The support platform includes a first projection spaced from the first end of the support members at least a distance equal to the width of a rim of the receptacle and a plurality of spaced apart projections at the second end of the support members. When the support platform is positioned on the receptacle, a surface of the first projection engages an inner surface of the receptacle and a surface of one of the second projections engages the opposite inner surface of the receptacle. The interaction of the first and second projections with the receptacle provide reinforcement to the receptacle to substantially prevent an upper edge of the receptacle from bending over.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
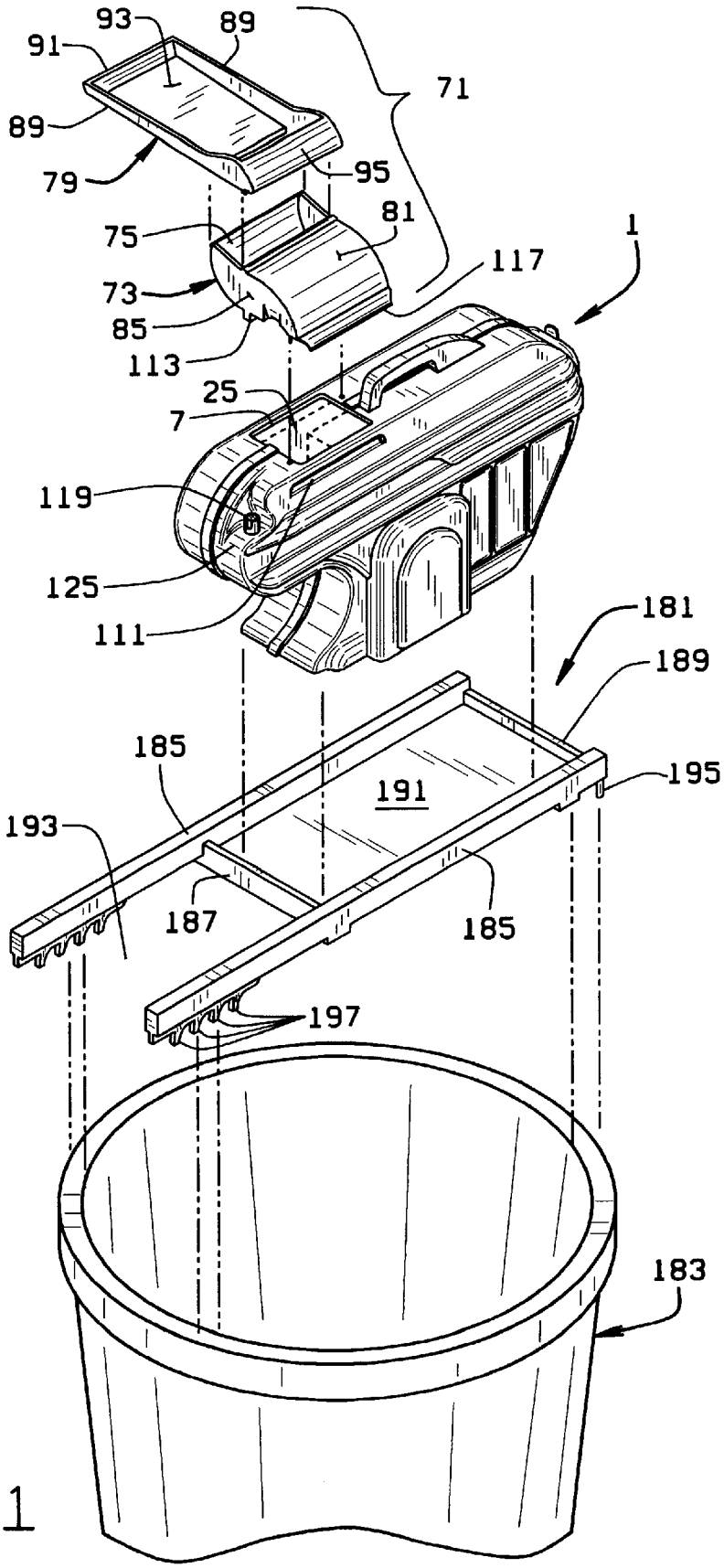
FIG. 1 is an exploded view of a can compactor of the present invention with its associated feed tray and support platform which supports the can compactor over a receptacle.

The following detailed description illustrates the invention by way of example and not by way of limitation. This description will clearly enable one skilled in the art to make and use the invention, and describes several embodiments, adaptations, variations, alternatives and uses of the invention, including what is presently believed to be the best mode of carrying out the invention.

A can compactor 1 of the present invention is shown generally in FIGS. 1–4B. The compactor 1 includes a housing 3 which encloses a frame 5. The housing 3 is preferably a two part housing and includes a right half 3*a* and a left half 3*b* which are connected together and which are connected to the frame 5 at various discrete points by a series of screws, not shown. A handle 6 is mounted to the compactor to facilitate transport of the compactor 1. The housing includes an opening 7 in its top and a smaller opening 8 beneath the opening 7. The front edges of the two openings 7 and 8 are vertically aligned, and the two openings are of substantially the same width. The top opening 7 is sized to allow a typical aluminum beverage can to pass therethrough either vertically or axially. The opening 7 is preferably about 3.75" wide and about 5.4" long. The bottom opening 8, however, is sized to allow only compacted cans to fall therethrough and is about 3.75" wide about 1.5" long. The housing is preferably made of plastic and can be made by any conventional form, such as by injection molding or vacuum molding.

Figure 3:
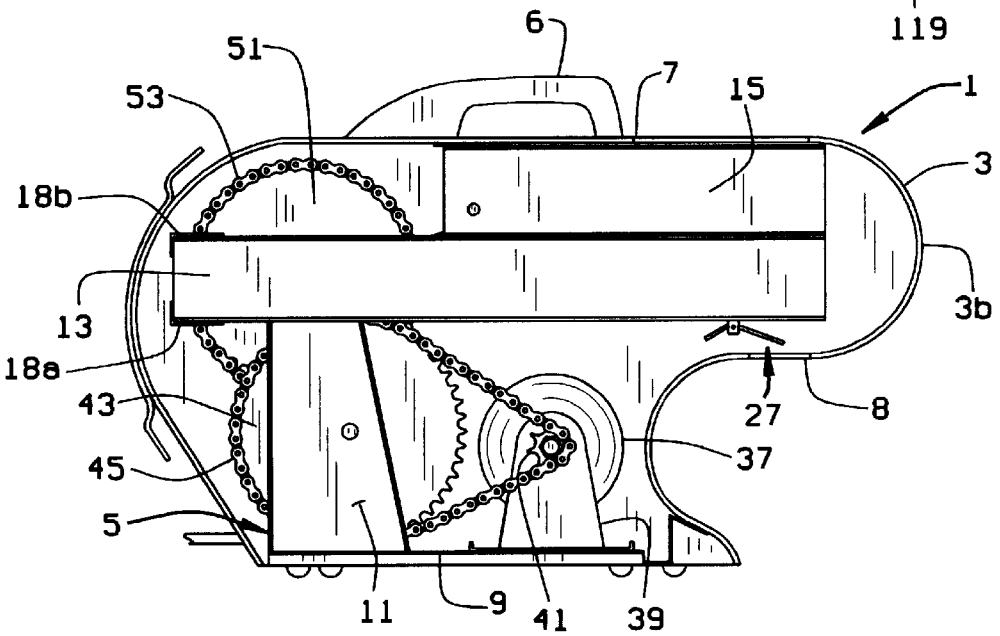
FIG. 3 is a side elevational view of the can compactor with the one side of the housing cover removed.
Figure 7:
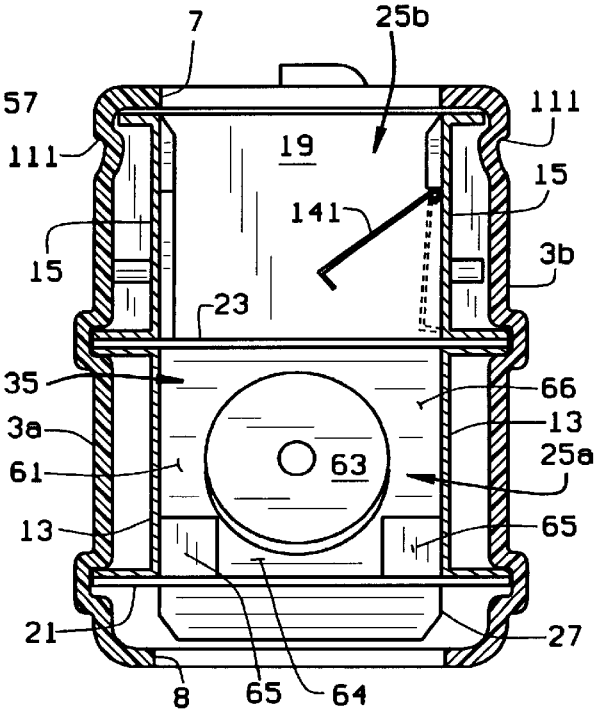
FIG. 7 is a cross-sectional view taken along line 7—7 of FIG. 4A showing the chamber of the can compactor and the indexing vane of the feeder control mechanism in a raised position, the vane being shown in a lowered position in phantom.

The frame 5 includes a base member 9, a pair of opposing vertical supports 11, and a pair of first horizontal beams 13. As seen in FIG. 3, the beams 13 extend from the back of the compactor 1 to a point spaced slightly from the front of the housing 3. A second pair of upper horizontal beams 15 are mounted to the top of the lower beams 13. The beams 15, as seen in FIG. 3 extend from a point approximately midway from the beams 13 to the front of the beams 13. The opposing beams 13 and 15 are connected together by a pair of front cross plates 17*a* and 17*b*. (FIGS. 4A, B) and rear cross plates 18*a* and 18*b*. The front cross plates 17*a,b* extend between the forward edges of the top and bottom openings 7 and 8. A rear cross plate 19 extends between the upper beams 15 at the rear edge of the top opening 7. A bottom plate 21 extends between the bottoms of beams 13. The bottom plate 21 extends from a point aligned with the back edge of the bottom opening 8 rearwardly to the back of the top beam 15. The distance between the bottom plate 21 and the cross-piate 17*a* forms an opening 22 which is aligned with the bottom opening 8 in the housing 3. A second horizontal plate 23 is sandwiched between the beams 13 and 15 (as seen in FIG. 7) and extends from about the back of the beam 15 to the rear cross plate 19. As can be appreciated, the beams 13 and 15, the front cross plates 17*a,b*, the rear cross-plate 19, and the bottom plate 21 define a compacting chamber 25*a* and a holding chamber 25*b* which are sized to accept a typical aluminum beverage can. As will be described below, the can is preferably compacted longitudinally, however the compactor will compact a can laterally if the can falls into chambers in a vertical orientation. The top opening 7 in the housing forms an entrance to the holding chamber 25*b* and the opening 8 at the bottom of the housing defines an exit from the compacting chamber 25*a*.

A closure vane 27 is positioned within the housing above opening 8 and below and at the front of the bottom plate 21. The closure vane 27 is made from an angled material having a forward leg 29 and a rearward leg 31 which are connected at an apex. Brackets 33 pivotally mount the vane 27 along its apex. The forward leg 29 is longer than the rearward leg 31 and is sized to close at least a portion of the opening 22. The rearward leg 31 is sized to be of sufficient weight to normally bias the forward leg 29 to substantially close the opening 22. As described below, when a can is compacted, the weight of the compacted can is sufficient to overcome the weight of the rearward leg 31, and the vane 27 will pivot to allow the can to fall through the openings 22 and 8.

Figure 4B:
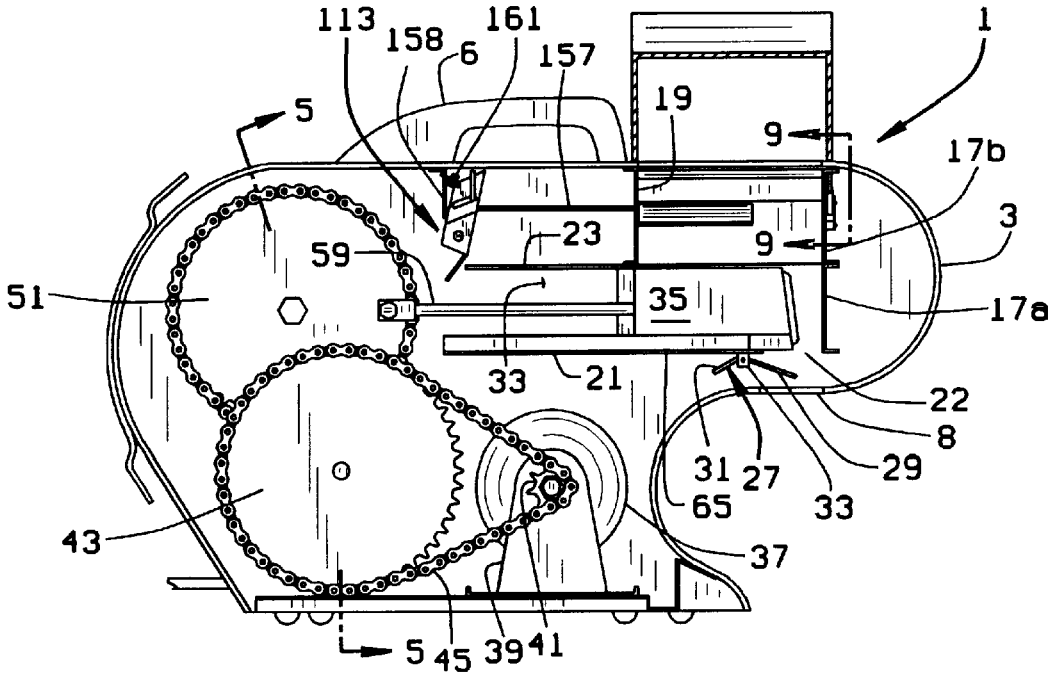
FIG. 4B is a side elevational view similar to FIG. 4A, but with the piston in the extended or forward position and the can feeder control being positioned to prevent entry of a can into the chamber.
Figure 5:
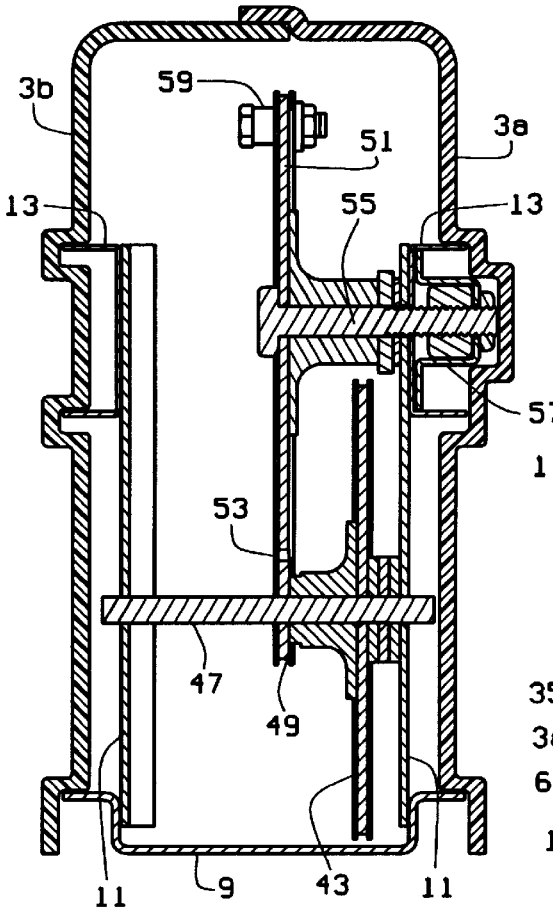
FIG. 5 is a cross-sectional view taken along line 5—5 of FIG. 4B, showing the interconnection of drive gears which drive the piston.
Figure 6:
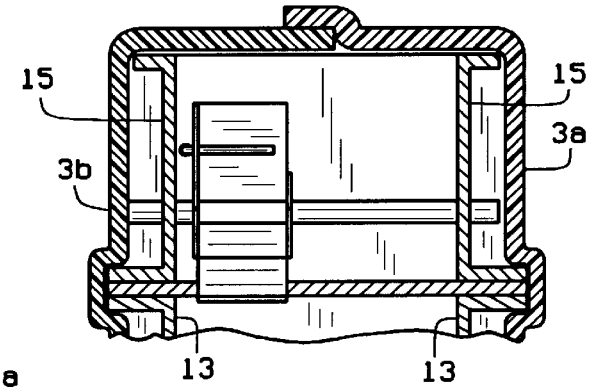
FIG. 6 is a cross-sectional view taken along line 6—6 of FIG. 4A to show the operation of the feed control mechanism.

The horizontal plates 21 and 23 and beams 13 define a slide path 33 (FIG. 4B) through which a ram 35 slides. The ram 35 is reciprocally driven to compact cans against the front walls 17*a* of the chamber 25. Preferably, the ram 35 is driven by an electric motor 37. The motor is preferably a ¼ horsepower motor which is capable of producing an output of between 1050 and 1200 rpm. The motor 37 is mounted on a motor mount 39 and drives a first gear or sprocket 41. The sprocket 41 drives a second sprocket 43, the two sprockets 41 and 43 being operatively connected by a roller chain 45. The sprocket 43 is mounted on an axle 47 (FIG. 5) which extends between the two vertical supports 11. A smaller sprocket 49 is also mounted on the axle 47. The sprocket 49 is operatively connected to the sprocket 43 to be driven by the sprocket 43. Lastly, the sprocket 49 drives a sprocket 51, the sprockets 49 and 51 being operatively connected by a chain 53. The sprocket 51 is journaled on an axle 55 which is mounted to the top of one of the vertical supports 11 and beam 13 by a journal bracket 57. The axle 55 may be in the nature of a bolt, as is shown in FIG. 5

The sprockets 41 and 49 are preferably eight tooth sprockets. The sprockets 43 and 51 are preferably 44–46 tooth sprockets. The use of these two sizes of sprockets gives approximately a thirty-three (33) fold reduction in the speed of the output of the motor. The speed reduction could be changed or eliminated if desired, however, the use of the slower speed creates a smoother action which will create more driving force behind the ram to compact a can. The gear reduction, coupled with the motor output, enables the motor to reciprocate the ram at a speed sufficient to compact approximately 35 cans per minute. This can be changed if desired, by altering the gear ratio and/or the motor output. Although the configuration described herein depicts roller chains and sprockets to effect speed reduction/power increase, it can readily be seen that a plurality of intermeshing gears or a planetary/sun gear arrangement will accomplish the same result.

Figure 4A:
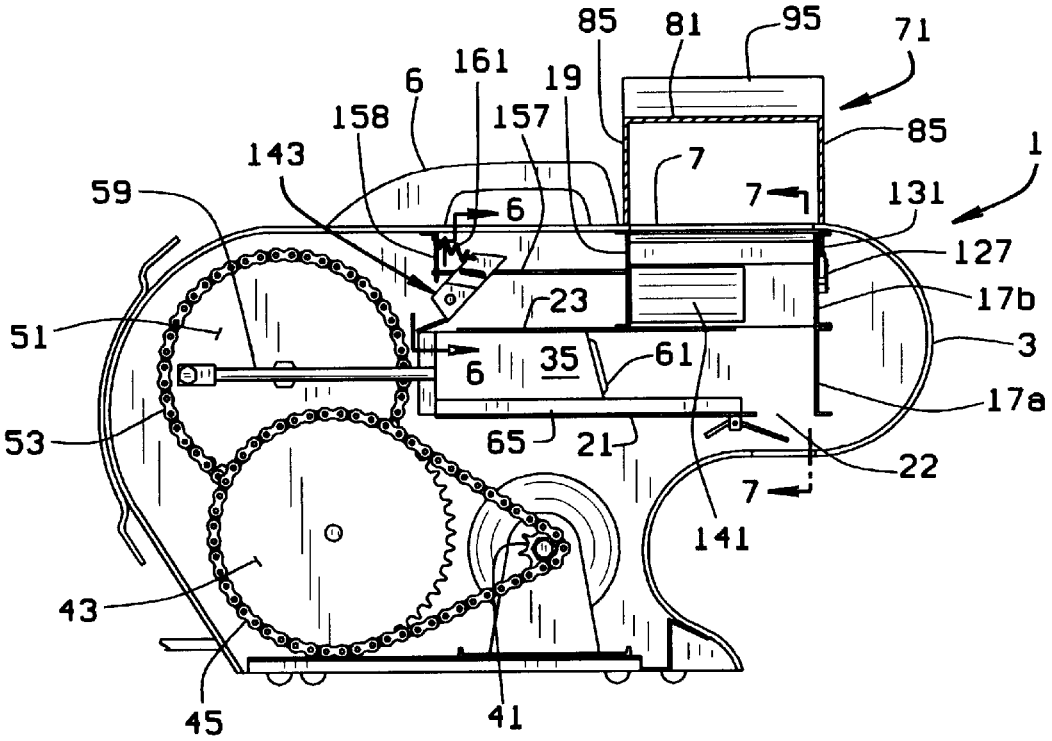
FIG. 4A is a side elevational view of the can compactor with the cover and frame member removed to show the drive, the piston, and the can feeder control; the piston being in a retracted position and the can feeder control being positioned to allow a can to fall into the chamber of the can compactor.

A piston arm 59 is pivotally mounted at one end to the sprocket 51 and pivotally mounted at another end to the ram 35. The piston arm 59 is mounted to the sprocket 51, offset from the center of the sprocket, and preferably near the edge of the sprocket. Thus, as the sprocket 51 is rotatably driven by the motor 37 and the sprockets 41, 43, and 49, the forward end of the arm 59 will be move forwardly and rearwardly to reciprocally drive the ram 35. The arm 59 and ram 35 are sized such that when the arm is in its retracted position (as shown in FIG. 4A), the front surface 61 of the ram 35 is at least at the back edge of the opening 7, and preferably rearward of the opening 7, so that a can be dropped into the chamber 25 to be axially compacted. When the arm 59 is in its forward or extended position (as shown in FIG. 4B), the ram front surface 61 is preferably at least to the back edge of the exit opening 22 so that the compacted can will fall through the openings 22 and 8 to exit the compactor 1.

As can be appreciated, the wall 17*a* of the compacting chamber 25*a* forms an anvil and the front surface 61 of the ram 35 pushes or compacts cans as the ram is moved from its rearward position to its forward position. Preferably, the compaction of the cans is up to 85%. As seen best in FIG. 13, the ram's front surface 61 is sloped at an angle of from about 1° to about 25° from the vertical, such that the top of the ram 35 is shorter than the bottom of the ram. Preferably, the slope is from about 3° to about 5°. Thus, when a can is compacted, the bottom of the ram 35 will contact the can prior to the top of the ram contacting the can. This will cause the bottom surface of the can (when the can is lying horizontally in the chamber 25) to be loaded prior to the top surface of the can being loaded. This uneven loading of the can will cause the can to buckle, and reduces the amount of power needed to compact the can. By sloping the front surface 61 of the ram 35, the compacting load needed to compact a can can be reduced by as much as 50%. This reduction in power can allow for the use of a smaller motor or enable the same motor to compact heavier cans.

Although the front surface of the ram is shown to be sloped from top to bottom, the slope could be reversed, i.e., the top surface of the ram could be longer than the bottom surface of the ram. Alternatively, the ram front surface could slope from side to side, instead of from top to bottom. Further, the anvil 17*a* could be sloped rather than the ram front surface 61. Any of these configurations will cause uneven loading, and hence buckling, of a can while it is being compacted.

Figure 13:
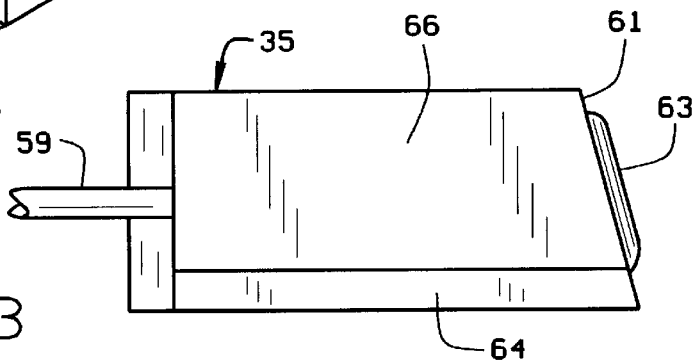
FIG. 13 is a side elevational view of the compacting piston, the slope of the forward surface of the piston being exaggerated for purposes of illustration.

To hold onto the can during compacting, a centering plug 63 is placed on the ram's front surface 61 (FIGS. 7 and 13). As is known, a typical beverage can (such as a soda can) has an annular wall or ring extending from the bottom and top of the can. The centering plug 63 is sized to be received within this ring of the can. As can be appreciated, the plug 63 will hold the can substantially vertically stationary during compacting of the can, and will thus help prevent the can from rising up in the chamber 25 during compacting of the can.

To longitudinally align the can to be compacted in the chamber 25, a pair of guide rails 65 are positioned on the plate 21 against the horizontal beams 13. The guide rails 65 extend from the rear edge of the opening 22 generally to the rear edge of the plate 21. This distance is approximately equal to the distance of travel of the ram 35 plus the length of the ram 35. The width of the compacting chamber 25*a* between the opposing sides is greater than the width or diameter of the average 12 oz. beverage can. Thus, the guide rails 65 are sized such that the space between their inner surfaces is less than the diameter of the beverage can. When a can to be compacted is dropped into the compacting chamber 25*a*, the guide rails 65 will align the can in the chamber so that its longitudinal axis is parallel to the longitudinal axis of the ram 35 and so that the center of the end wall of the can is generally aligned with the ram centering plug 63. The guide rails 65 will also substantially hold the position of the can in the chamber while the can is being compacted.

So that the ram 35 fully fills the compacting chamber 25*a* from top to bottom as it extends into the chamber, the ram 35 has a generally T-shape, as can be seen in FIG. 7. The ram has a stem portion 64 which extends between the guide rails 65 and an upper or main portion 66 which extends between the frame members 13. The centering plug 63, as best seen in FIG. 7, is vertically centered over the complete front surface 61 of the ram. The plug 63 thus extends over part of the stem 64 as well as the main portion 66 of the ram 35.

Figure 2:
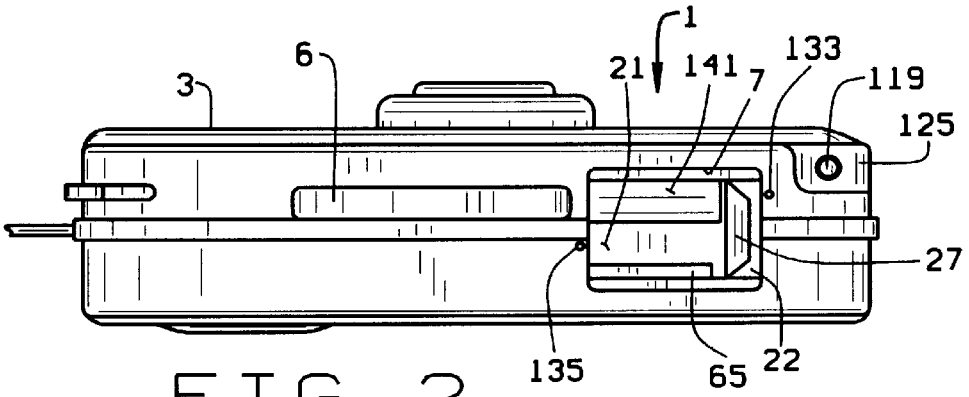
FIG. 2 is a top plan view of the can compactor.
Figure 2A:
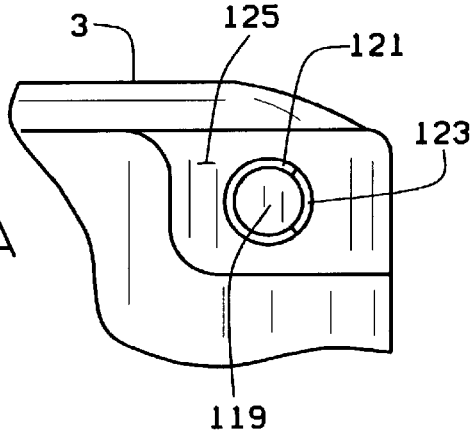
FIG. 2A is an enlarged top plan view of the compactor showing the push-button switch of the compactor.

The compactor includes a switch 119 (FIGS. 2 and 2A) to turn on the motor 37 to operate the ram. The switch 119 is preferably a momentary-on switch, and must therefore be manually maintained in a closed position to operate the compactor 1. Preferably, the switch is a push button switch. To prevent the switch from accidentally being activated, the switch 119 is surrounded by a guard wall 121. The wall 121 has a height at least equal to the height of the button when it is in its raised position. Thus, someone or something cannot accidentally press down on the button to activate the compactor. The guard wall 121 does not completely surround the switch 119. Rather, it extends only about 270° around the switch. Therefore, there is an opening 123 in the wall 121 which will allow for easier access to the push button 119 by the operator. To further insulate the switch 119 from accidental activation, the push button switch 119 is positioned on a surface 125 which is spaced below the top surface of the housing.

Figure 9:
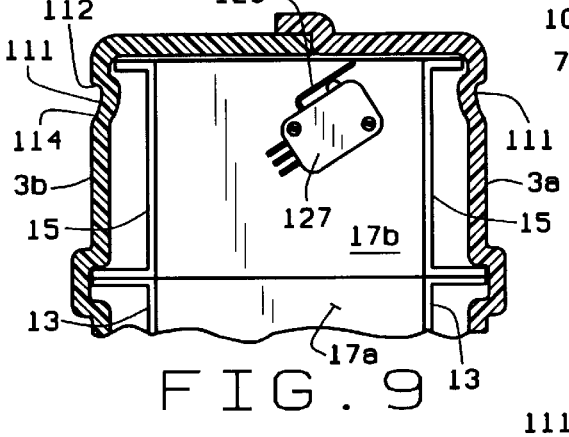
FIG. 9 is a fragmentary cross-sectional view taken along line 9—9 of FIG. 4B to show the cut-off switch of the can compactor.
Figure 10:
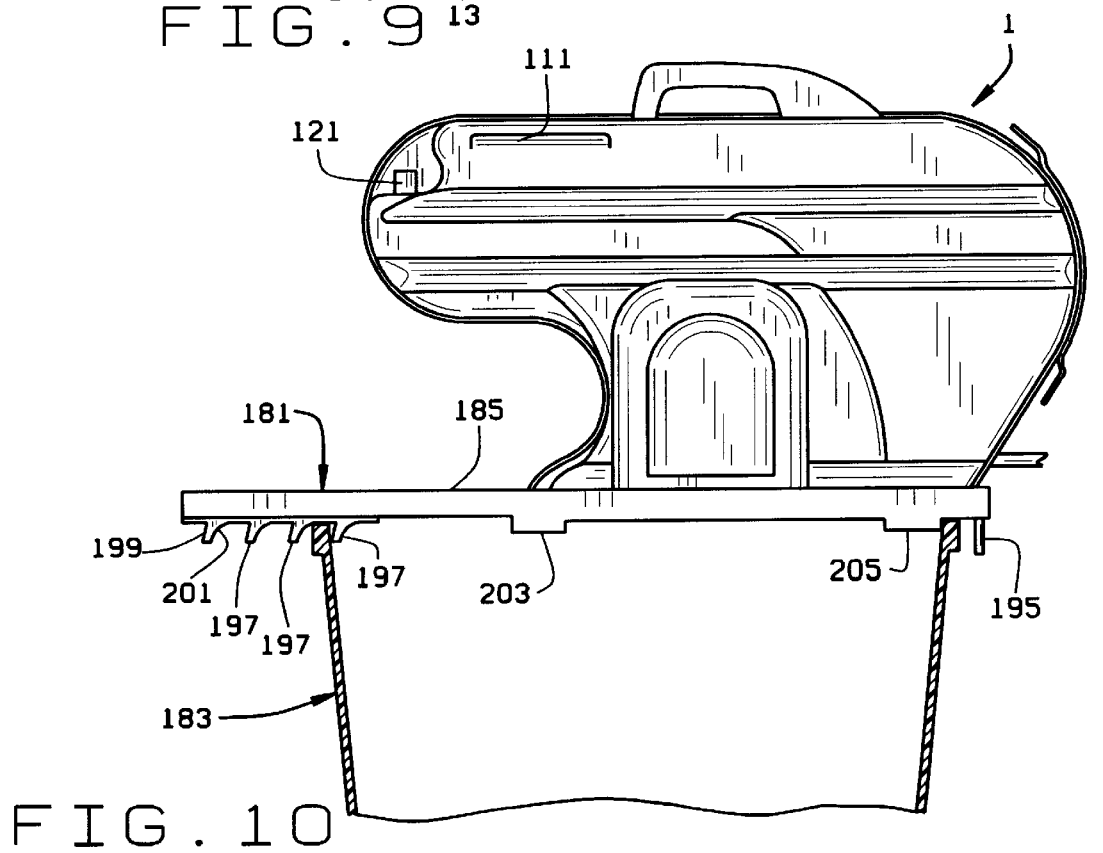
FIG. 10 is a side elevational view of the can compactor placed atop its supporting platform and the supporting platform being positioned on a receptacle, the receptacle being shown in cross-section.

Preferably, the compactor includes a cut-off switch 127 (FIG. 9) positioned in the electrical circuit between the switch 119 and the motor 37. The cut-off switch will prevent operation of the compactor when the feed tray 71 is not mounted to the housing. The cut-off switch 127 is mounted to the cross plate 17*b*, on the outside surface of the cross-plate, and near the top edge of the cross-plate. The switch includes an arm 129, which, when depressed, will close the circuit, such that depressing the switch 119 will activate the motor 37. The feed tray 71 includes a finger 131 which passes through an opening 133 (FIG. 2) in the housing. The finger 131 is sufficiently long to extend to the arm 129 to depress the arm 129 to close the switch 127, when the feed tray 71 is mounted to the housing 3. The feed tray 71 can be mounted to the housing 3 to extend from either side of the housing. Thus, the feed tray 71 includes two fingers 131, and the housing includes a second opening 135, to accept the second finger 131 when the feed tray is mounted to the housing.

Figure 11:
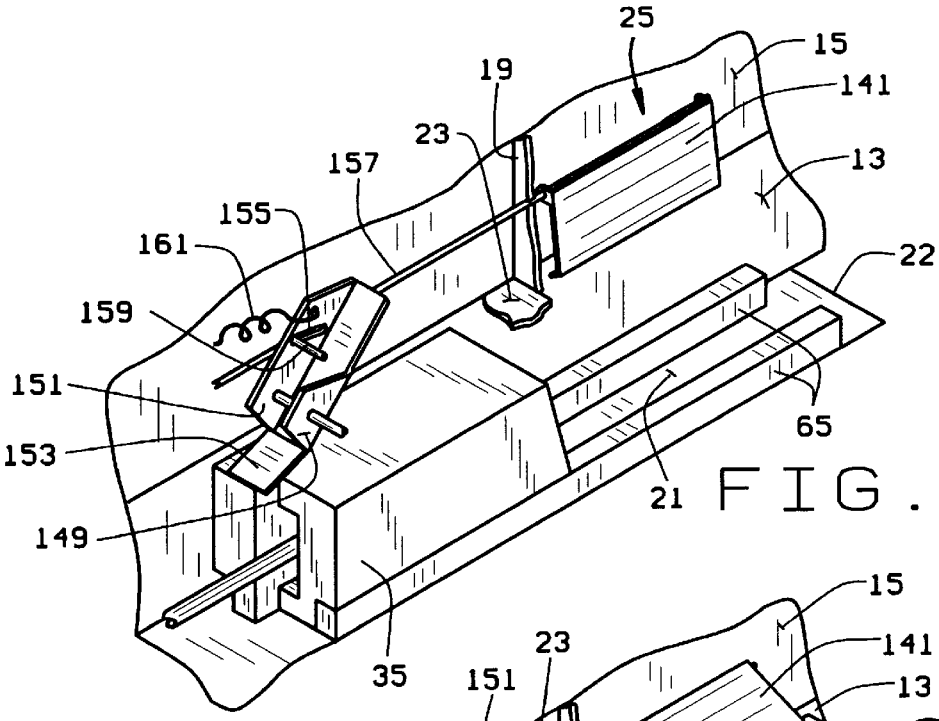
FIG. 11 is a perspective view of the indexing mechanism of the feed control, the feed control vane being shown in a lowered position to allow cans into the chamber.
Figure 12:
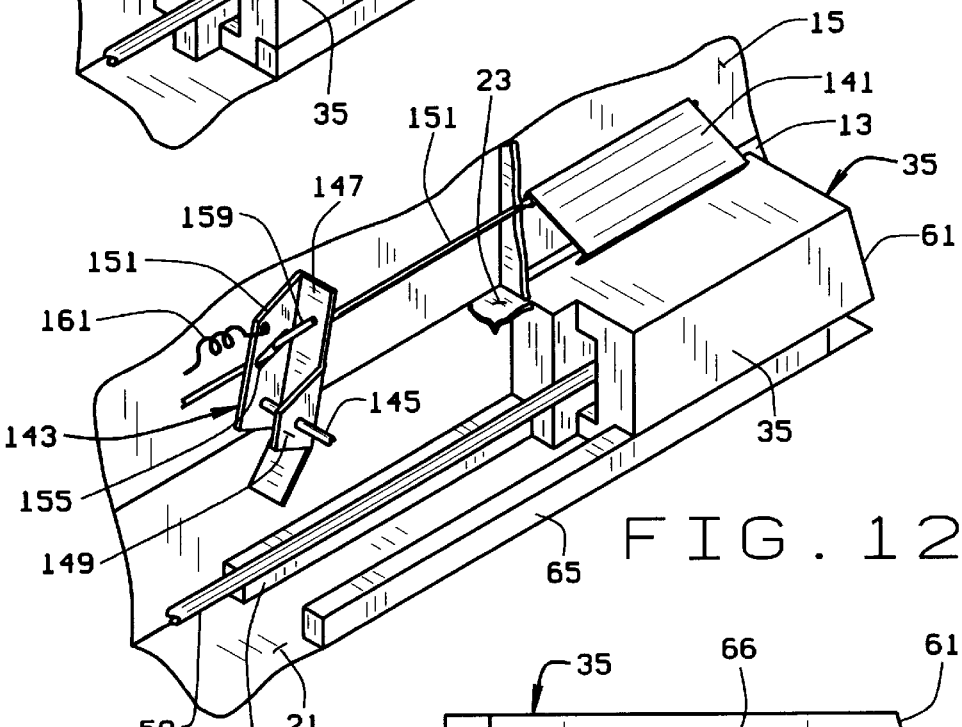
FIG. 12 is a view similar to the view of FIG. 11, but with the vane being shown in a raised position to prevent a can from entering the chamber.

A feed control vane 141 is pivotally mounted in the holding chamber 25*b* on one of the frame members 15. The vane 141 is pivotable between a lowered position (FIGS. 4A and 11) to allow a can C to enter the chamber 25 through the opening 7, and a raised position (FIGS. 4B and 12) to prevent a can from entering the chamber 25*b*. Although the vane preferably does not have a side-to-side width equal to the width of the chamber 25*b*, the width of the vane 141 is sufficient to effectively close the chamber against entry of a can when the vane is in its raised position. As shown in FIGS. 4A,B, 11 and 12, the movement of the vane between its raised and lowered positions is controlled by the movement of the ram 35. When the ram is moving forwardly, the vane 141 is moved from its lowered position to its raised position, so that the vane is fully raised when the ram is fully extended. When the ram has nearly reached its most rearwardly position, the vane is moved from its raised to its lowered position, so that when the ram is fully retracted, the vane is fully lowered.

A vane actuator 143 is provided which interacts with the ram 35 to move the vane 141 between its raised and lowered positions. As seen best in FIGS. 11 and 12, the actuator 143 is mounted on a shaft 145 extending inwardly from the frame member 15 so that the actuator can pivot about the shaft 145. The actuator 143 includes a bottom 147, an inner wall 149, an outer wall 151, and a tail 153. The inner and outer walls 149 and 151 extend generally perpendicularly from the sides of the bottom 147, the inner wall 149 being shorter than the outer wall 151. The tail 153 slopes upwardly slightly relative to the plane of the actuator bottom 149. The actuator outer wall 151 includes a slot 155 which forms an angle of about 45° with the actuator bottom 147.

An actuator arm 157 extends rearwardly from the feed control vane 141, through the cross-plate 19, to be rotatably journaled in a plate 158. The plate 158 (FIGS. 4A,B) extends from the frame member 15 and is placed behind the actuator 143. The arm 157 passes behind the actuator outer wall 151 to be between the actuator wall 151 and the frame member 15. A finger 159 extends from the arm 157 to pass through the actuator slot 155. The actuator is biased to a raised position (FIGS. 4B and 12) by a spring 161 (FIGS. 4A,B) which extends between the plate 158 and the forward, upper corner of the actuator outer wall 151. In this position, the actuator slot 155 cooperates with the finger 159 to rotate the arm 151 to cause the vane 141 to pivot to its raised position. When the ram 35 is pulled rearwardly by the piston arm 59, the back surface of the ram will engage the actuator tail 153, as seen in FIGS, 4A and 11, to cause the actuator to pivot downwardly (i.e., in a clockwise direction with reference to FIG. 11). This will cause the slot 155 to move downwardly, and the interaction of the finger 159 with the edge of the slot 155 will cause the finger 159 to pivot downwardly. This, in turn will cause the arm 151 to rotate in a clockwise direction to cause the vane 141 to move to its lowered position, thereby opening the opening 7 to the chamber 25. As the ram 35 moves forwardly, the ram comes out of contact with the actuator 143, and the spring 161 will pull on the actuator to pivot the actuator counterclockwise (reference being made to FIGS. 4A,B, 11, and 12). The interaction of the finger with the slot will cause the finger to pivot upwardly, thereby causing the arm to rotate in a counterclockwise direction. The counterclockwise rotation of the arm 157 will cause the vane 141 to move to its raised position (FIGS. 4B and 12) to close the opening 7 against entry of a can into the chamber 25.

A hopper or feed tray 71 (FIGS. 1, 4A, B and 8) is provided to deliver the cans into the chamber. The feed tray, as is described below is removably securable to the housing 3 of the compactor 1, and is shaped to be mounted to the housing 3 to cover the opening 7 to the chamber 25. The feed tray 71 includes a body 73 having an entrance 75 and an exit 77 and a tray 79. The body 73 and tray 79 are shown as two separate pieces in the figures. However, they could as easily be formed as a unitary one-piece component. The entrance 75 to the feed tray body 73 is sized to have a side-to-side width greater than the length (height) of a beverage can and to have a front-to-back length greater than the diameter of the can. The exit 77 is sized to correspond generally to the size of the chamber opening 7 in the housing 3 to fully cover the opening 7 when the feed tray 71 is applied to the housing. The feed tray 71 is sized to hold nine separate cans, not including the can which is in the chamber 25. The tray could of course be sized to hold more or fewer cans, as may be desired.

The feed tray body 73 includes a top wall 81 and a bottom wall 83 which are joined together by side walls 85. The top wall 81 and bottom wall 83 of the feed tray body 73 are both arcuate, so that the entrance 75 is horizontally and vertically offset from the exit 77. The side walls 85 are spaced apart a distance slightly greater than the length of an average 12 oz. beverage can. The curvature of, and spacing between, the top and bottom walls 81 and 83 are designed so that a can which is placed in entrance 75 will roll of its own accord to the exit 77. Thus, a can will be dropped into the holding chamber 25*b* wherein feed control vane 141 will hold the can, axially align the can with the ram 35, and then the can will be axially compacted by the ram.

Figure 8:
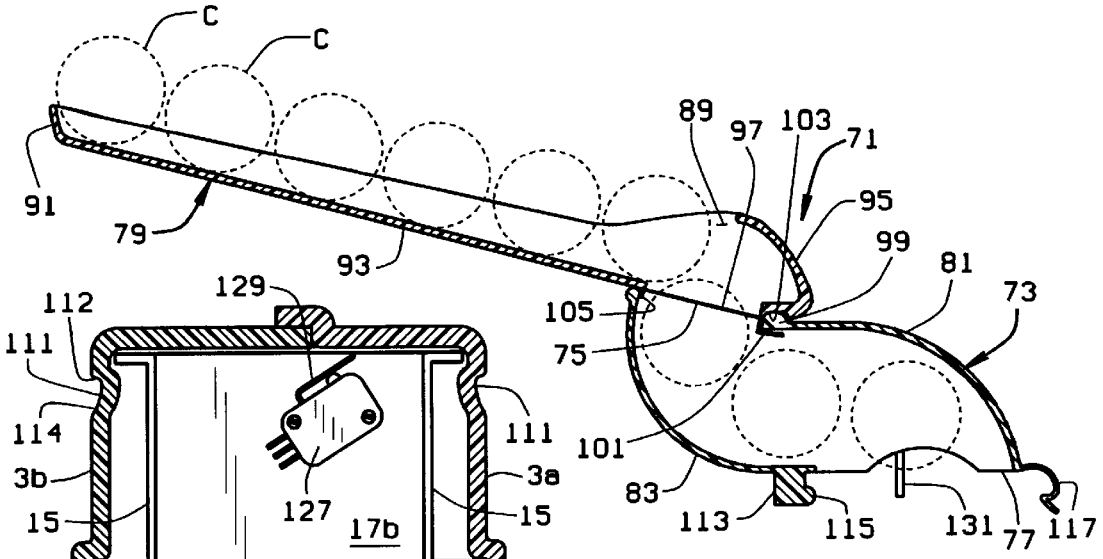
FIG. 8 is a cross-section of the feed tube and feed tray together as an assembly, cans being shown in phantom on the feed tube and tray.

The tray 79 extends diagonally (i.e. outwardly and upwardly) from the housing 73. As best seen in FIG. 1, the tray 79 includes side rails 89 and a back rail 91. A plate 93 extends between the side rails 89 and defines the surface upon which the cans will roll when the compactor 1 is operated. The side rails 89 extend forwardly of the front edge of the plate 93, as seen in FIG. 8. The side rails 89 extend past the end of the plate 93 and their front edges are connected by a front shield 95. The plate 93, side rails 89, and shield 95 cooperate to form an exit 97 which is the same size as the entrance 77 to the feed tray body 73. As seen in FIG. 8, the tray 79 is sloped. The slope is sufficient to cause the cans C to roll along the tray 79 into the body 73 and into the holding chamber 25*b*. As will be discussed below, the dropping the cans C into the chamber 25*b* is preferably controlled so that only one can can enter the chamber at a time, and so that a new can will not enter the compacting chamber 25*a* until the can already in the compacting chamber 25*a* has been compacted and has exited the chamber 25*a*.

As noted above, the feed tray is formed in two pieces. To join the two pieces together, the body top wall 81 includes a lip or roll 99 at the forward edge of its entrance 75. The shield 95 has an L-beam 101 at its bottom. The L-beam 101 and the shield 95 define a channel 103 sized to receive the roll 99 in the body top wall 81. A lip 105 extends downwardly from the forward edge of the plate 93. To apply the tray 79 to the body 73, the channel 103 is applied over the roll 99, and the tray 79 is pivoted downwardly until the lip 105 is received along the inner edge of the bottom wall 83, as seen-in FIG. 8. Preferably, the fit is somewhat tight, so that there will be a friction fit between the tray 79 and the feed tray body 73.

As can be appreciated, because the entrance 75 to the feed tray body 73 is off-set from the exit 77, should the need arise to reach into the chamber 25, the operator would be unable to do so. Therefore, the feed tray 71 is removably mounted to the housing 3 and may be mounted on either the left side or right side of compactor 1. As seen in FIGS. 1, 7, 9, and 10, the compactor housing 3 includes symmetrical channels 111 in its sides. The channels have a length slightly greater than the front-to-back length of the housing opening 7. They are placed on the housing sides, near the top of the housing, to extend from a point slightly forward of the front edge of the opening 7 to a point slightly rearward of the opening 7. The channels 111, as seen best in FIGS. 7 and 9, have a generally horizontal top edge 112 and a sloping wall 114. The feed tray body 73 includes a beam 113 having a rib 115 which faces inwardly, or toward the feed tray body exit 77. The rib 115 is sized to be received in one of the channels 111, and the beam 113 is sized to position the rib 115 so that it can be tightly and snugly received in one of the channels 111. The body 73 also includes a curved member 117 sized to extend around the top comer or opposite edge of the housing 3 to extend into the second channel 111. As shown in the drawings, the beam 113 and rib 115 are mounted to the bottom of the body bottom wall 83 near one edge of the body exit 77 and the member 117 is mounted to, or extends from, the bottom of the top wall 81 at the opposing edge of the exit 77. However, the positions could be reversed if desired.

To mount the feed tray 71 to the housing 3, the rib 115 is placed in one of the housing channels 111, and the feed tray 71 is pivoted about the rib 115 until the member 117 engages the opposing channel 111. The rib 115 and member 117, along with the channels 111, are sized to create a snap fit between the housing 3 and the feed tray 71. As can be seen in FIG. 1, the feed tray 71 is mounted to the housing 3 such that the tray 79 extends generally perpendicular to the axis of the ram and can be mounted on either side of compactor 1.

In operation, once the feed tray 71 is placed on the housing 3, and the feed tray is filled with cans, the switch 119 is depressed to activate the motor. The operation of the compactor can be started at any point along the cycle of the ram 35, and hence at any position of the vane 141. If the compactor is started with the ram 35 in a rearward position, then the vane will be in its lowered position, and the first can will drop into the chamber to be compacted. If the ram is in its forward position, the first can will remain in the feed tray body 73 until the vane 141 is lowered. Once the first can drops into the chamber, the second can will follow the first can, and will rest on the first can. However, as the ram 35 is moved forward, the vane 141 moves from its lowered to its raised position. As the vane 141 pivots to its raised position, it will lift the second can off the first can, to move the second can out of the way of the ram 35. Thus, the ram will only compact one can at a time. When the first can is compacted, the compacted can will fall out the chamber exit 22 and through the opening 8 in the bottom of the housing 3 to exit the compactor 1. Then, as the ram cycles rearwardly, the vane 141 will pivot to its lowered position to allow the next (second) can to fall into the chamber 25. This cycle, of compacting only one can at a time, and dropping the next can into the chamber 25 only after the prior can has exited the chamber, continues for as long as cans are fed into the compactor and actuating switch 119 is depressed.

As can be appreciated, the feed tray 71 positions the cans C so that the axes of the cans are parallel to the axis of the ram 35. Further, the use of the vane 141 and the guide rails 65 facilitates the axial (horizontal) orientation of the cans in the chamber 25. Lastly, the vane 141 only allows a can to be fully dropped into the chamber 25 when the ram is in its retracted position, and hence only when the chamber 25 is empty. All these factors help reduce to likelihood that the compactor will jamb.

To facilitate collection of compacted cans, the compactor 1 may be placed on a support platform 181 which will support the compactor 1 over a collection receptacle or bin 183, such as a garbage can. The cans will thus fall directly into a the bin 183, which preferably is lined with a liner, such as a garbage bag, so that the compacted cans can be easily lifted out of the bin 183 for recycling. The support platform (FIGS. 1 and 10) includes a pair of side rails 185, a front rail 187, and a rear rail 189. The rear rail 189 extends between the side rails 185 at the back thereof. The front rail 187 extends between the side rails 185 approximately midway along the rails 185. A support surface 191 extends between the rails 185, 187, and 189, and is joined to the rails to support the compactor 1 on the surface 191. The distance between the side rails 185 is slightly wider than the width of the compactor 1 and the distance between the front and back rails 187 and 189 is slightly longer than the length of the base of the compactor 1. As seen in FIG. 1, an open area 193 is formed between the side rails 185 and the front rail 187 forwardly of the front rail. The chamber exit 22 and opening 8 at the bottom of the housing 3 are over the open area 193 when the compactor 1 is placed on the support platform 181. Thus, compacted cans will fall from the compactor 1, through the space 193 and directly into the bin 183.

Rear teeth 195 extend downwardly from the back of the support platform side rails 185, and a plurality of spaced apart teeth 197 extend downwardly from the front of the side rails 185. As seen best in FIG. 10, the teeth 197 each have a generally flat front surface 199 which slopes forwardly and downwardly and a generally curved rear surface 201. The teeth are spaced apart a distance slightly greater than the width of the rim of the bin 183. A pair of strengthening ribs 203 and 205 extend between the side rails beneath the surface 191. The rib 205 is spaced forwardly from the rear teeth 195 a distance slightly greater than the rim of the bin 183. The rib 203 is positioned beneath the front of the surface 191.

The teeth 197, as can be appreciated, will interact with the bin 183 to substantially prevent movement of the platform 181 relative to the bin 183 when the compactor is placed on it. As can be appreciated, the compactor may be heavy, and can weigh as much as 20 lbs. Such weight may be sufficient to cause the top edges of the bin 183 to roll or fold over upon itself, especially if the bin is a plastic garbage can. The use of the teeth 197 and rib 205 will effectively brace the rim of the bin 183 to prevent such inward rolling or folding. Therefore, the platform 181 will also serve to stabilize the bin 183.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although a chain and sprocket drive is used, the chain and sprocket drive could be replaced with a belt and pulley system. Alternatively, a plurality of gears could be used which directly drive each other. The motor and sprockets could be replaced with a pneumatic or hydraulic drive to reciprocally drive the piston. Any other drive which is capable of reciprocally driving the ram 35 could also be used. These examples are merely illustrative.

I claim:

1. A can crusher comprising:

a housing;

a chamber in said housing sized to accept cans for compacting, said chamber having a front wall, a back wall, a floor, a feed opening through which cans can enter the chamber to be compacted and an exit opening through which compacted cans can exit said chamber;

a reciprocating ram which compacts cans in the chamber, said ram being movable between a forward position and a rearward position in said chamber to compact cans;

a drive for reciprocally moving said ram between said forward and rearward positions;

a hopper positioned above said chamber inlet, said hopper being sized to accept cans to deliver cans to said chamber for compacting;

a feed control which prevents a second can from entering the chamber before a first can exits the chamber;

an actuating switch for actuating said drive; said actuating switch being a momentary-on switch, said switch actuating said drive being actuated only when said switch is maintained in a drive actuating position; and a guard for said actuating switch, said guard being shaped and sized to prevent accidental actuation of said can compactor, said actuating switch comprising a push-button switch, said guard comprising a wall which extends around at least a portion of said push-button switch and has a height at least equal to the height of the push-button when said push button is in a raised, off position.

2. The can crusher of claim 1 including a cut-off switch, said cut-off switch, actuating switch, and said drive comprising an electrical circuit, said cut-off switch being selectively moved between an open mode in which said circuit is opened and said drive cannot be actuated and a closed mode in which said drive can be actuated.

3. The can crusher of claim 2 wherein said hopper is removably mounted on said housing, said hopper having a finger which extends into said housing to close said cut-off switch and place said cut-off switch in said closed position.

4. The can crusher of claim 3 wherein said hopper comprises a sloping feed tray extending from said can compactor.

5. A can crusher comprising:

a housing;

a chamber in said housing sized to accept cans for compacting, said chamber having a front wall, a back wall, a floor, a feed opening through which cans can enter the chamber to be compacted and an exit opening through which compacted cans can exit said chamber;

a reciprocating ram which compacts cans in the chamber, said ram being movable between a forward position and a rearward position in said chamber to compact cans;

a drive for reciprocally moving said ram between said forward and rearward positions;

a hopper positioned above said chamber inlet, said hopper being sized to accept cans to deliver cans to said chamber for compacting; and a feed control which prevents a second can from entering the chamber before a first can exits the chamber; said feed control including a vane in said chamber, a vane actuator pivotally mounted in said housing to be movable between a first position and a second position and a connecting rod extending between said vane and said vane actuator to operably connect said vane to said vane actuator, said vane extending along a side of said chamber beneath said chamber opening, said vane being movable between an upper position in which said vane closes said opening sufficiently to prevent a can from entering said chamber and a lower position in which said vane opens said chamber entrance to permit a can to enter said chamber to be compacted; whereby movement of said vane actuator from said first position to said second position moves said vane from its upper position and its lower position; said vane actuator being positioned in said housing to be in the path of movement of said ram such that said vane actuator is pivoted by said ram, whereby when said ram moves rearwardly, said vane actuator is moved from its first position to its second position to move the vane from its upper position to its lower position to allow a can to enter the chamber and when said ram moves forwardly, said vane actuator moves from its second position to its first position to move the vane from its lower position to its upper position to prevent a can from entering the chamber.

6. The can crusher of claim 5 wherein said vane actuator includes a side wall generally parallel to a side wall of said ram and the path of movement of said ram, and a slot in said vane actuator side wall; said connecting rod including an arm having a first end fixed to said vane and a second end, and a finger extending from said arm and through said slot of said vane actuator; said slot being configured and positioned on said vane actuator side wall, such that said vane actuator and said connecting rod finger cooperate to translate pivotal motion of said vane rod to rotational motion of said arm; the rotational motion of the arm causing the vane to pivot between its upper and lower positions.

7. A can crusher comprising:

a housing;

a chamber in said housing sized to accept cans for compacting, said chamber having a front wall, a back wall, a floor, a feed opening through which cans can enter the chamber to be compacted and an exit opening through which compacted cans can exit said chamber;

a reciprocating ram which compacts cans in the chamber, said ram being movable between a forward position and a rearward position in said chamber to compact cans;

a drive for reciprocally moving said ram between said forward and rearward positions;

a hopper positioned above said chamber inlet, said hopper being sized to accept cans to deliver cans to said chamber for compacting;

a feed control which prevents a second can from entering the chamber before a first can exits the chamber; and a closure which at least partially closes the exit from the chamber; said closure being pivotally mounted to said compactor and biased to a closed position, said closure being opened by the weight of a compacted can exiting said chamber.

8. The can crusher of claim 7 wherein said chamber front wall defines an anvil against which cans are compacted and said ram has a longitudinal axis and front surface which engages said cans when compacting a can; and wherein one of said ram front surface and said anvil lies in a vertical plane that is perpendicular to the longitudinal axis of said ram and the other of said ram front surface and anvil is offset from the longitudinal axis of the ram to define a sloping surface.

9. The can crusher of claim 8 wherein said sloping surface defines an angle of from about 1° to about 25° with the longitudinal axis of the ram.

10. The can crusher of claim 9 wherein said ram front surface comprises said sloping surface; said front surface of said ram sloping downwardly such that an upper surface of said ram is shorter than a lower surface of said ram.

11. The can crusher of claim 8 wherein the ram includes a centering pad on said ram front surface, said centering pad maintaining a can axially positioned in said chamber from moving vertically substantially relative to said ram front surface.

12. The can crusher of claim 7 wherein said feed control includes a vane in said chamber, said vane extending along a side of said chamber beneath said chamber opening, said vane being movable between an upper position in which said vane closes said opening sufficiently to prevent a can from entering said chamber and a lower position in which said vane opens said chamber entrance to permit a can to enter said chamber to be compacted.

13. The can crusher of claim 7 wherein said drive includes a motor and a ram driving wheel rotatably driven by said motor; a piston arm mounted at one end to said wheel and at another end to said ram, said piston arm being mounted to said wheel at a point radially offset from a center of said wheel.

14. The can crusher of claim 13 wherein the drive includes a speed reducer driven by said motor, said speed reducer being operatively connected to said ram driving wheel to drive said ram driving wheel at a rate slower than the rotational output of said motor.

15. The can crusher of claim 7 wherein the can crusher is portable.

16. The can crusher of claim 7 wherein said can crusher can crush up to about thirty-five cans per minute.

* * * * *